US008256779B1

(12) United States Patent
Johnson

(10) Patent No.: US 8,256,779 B1
(45) Date of Patent: Sep. 4, 2012

(54) APPARATUS FOR PRACTICING BALANCE NEEDED TO PERFORM SPORTING-BOARD TRICKS

(76) Inventor: Michael B. Johnson, Red Bank, NJ (US)

( * ) Notice: Subject to any disclaimer, the term of this patent is extended or adjusted under 35 U.S.C. 154(b) by 346 days.

(21) Appl. No.: 12/729,161

(22) Filed: Mar. 22, 2010

Related U.S. Application Data

(60) Provisional application No. 61/161,793, filed on Mar. 20, 2009.

(51) Int. Cl.
*B62M 1/00* (2010.01)

(52) U.S. Cl. ..... 280/87.042; 280/87.041; 280/87.01

(58) Field of Classification Search ..... 280/87.041, 280/87.042, 87.01
See application file for complete search history.

(56) References Cited

U.S. PATENT DOCUMENTS

| | | | | | |
|---|---|---|---|---|---|
| 3,771,811 | A * | 11/1973 | Bueno | 280/87.042 |
| 4,160,554 | A * | 7/1979 | Cooney | 280/87.042 |
| D421,282 | S * | 2/2000 | Orr | D21/765 |
| D430,635 | S * | 9/2000 | Danache | D21/765 |
| 6,338,494 | B1 * | 1/2002 | Killian | 280/87.042 |
| 6,419,248 | B1 * | 7/2002 | Kay | 280/87.042 |
| 6,758,483 | B1 * | 7/2004 | Sypniewski | 280/87.041 |
| 6,789,806 | B2 * | 9/2004 | Santa Cruz et al. | 280/14.21 |
| 6,942,487 | B2 * | 9/2005 | Corbalis | 280/87.042 |
| 7,237,784 | B1 * | 7/2007 | Monteleone | 280/87.042 |
| 7,425,017 | B2 * | 9/2008 | Mash | 280/607 |
| D594,076 | S * | 6/2009 | Drummer | D21/765 |
| 2007/0170677 | A1 * | 7/2007 | Wake | 280/87.042 |

* cited by examiner

*Primary Examiner* — J. Allen Shriver, II
*Assistant Examiner* — James M Dolak
(74) *Attorney, Agent, or Firm* — Julian F. Santos

(57) ABSTRACT

An apparatus for practicing balance required for performing a trick of a sporting board traveling over a given terrain is provided. The apparatus may include a first or "top" deck, a second or "bottom" deck and one or more pivot elements. The top and bottom decks may respectively include first and second side edges, first and second (e.g., nose and tail) ends, first and second (e.g., upper and lower) surfaces and one or more apertures. The bottom deck may also include a centerline that is defined between the bottom-deck-nose and bottom-deck-tail ends. The top-deck-upper surface is adapted for a rider to ride on. The bottom-deck-upper surface is adapted to be in communication with at least a portion of the top-deck-lower surface, and the bottom-deck-lower surface is adapted to be positioned over a surface of the ground. The pivot elements are (i) disposed at least in part in one of the top-deck and bottom-deck apertures, and (ii) adapted to allow the top deck to rotate horizontally about an axis perpendicular to the bottom deck when the apparatus is in motion. When the top deck is positioned at an angle to the centerline causing the top deck to overhang at least a portion of the first side edge of the bottom deck, the top-deck-lower surface is in communication with the bottom-deck-upper surface above an intersection of the first side edge of the second deck and the bottom-deck-upper surface; thereby, permitting the rider to practice maintaining the balance with the top deck so positioned and with the apparatus in motion.

16 Claims, 8 Drawing Sheets

APPARATUS FOR PRACTICING BALANCE NEEDED TO PERFORM SPORTING-BOARD TRICKS

BACKGROUND

Field

The present invention relates generally to balance trainers and/or balance boards, and more specifically, to an apparatus for practicing a balance required for performing a trick with a sporting board traveling over a given terrain.

SUMMARY

An apparatus for practicing balance required for performing a trick with a sporting board traveling over a given terrain is provided. The apparatus may include a first deck, a second deck and at least one pivot element. The first deck may include first and second side edges, first and second ends, first and second surfaces and at least one first aperture. The first surface is adapted for a rider to ride on. The second deck may include first and second side edges, first and second ends, a centerline defined between the first and second ends, first and second surfaces and at least one second aperture. The first surface of the second deck is adapted to be in communication with at least a portion of the second surface of the first deck, and the second surface of the second deck is adapted to be positioned over a surface of the ground. The at least one pivot element is disposed at least in part in the at least one first and at least one second apertures. The pivot element is adapted to allow the first deck to rotate horizontally about an axis perpendicular to the second deck when the apparatus is in motion. When the first deck is positioned at an angle to the centerline causing the first deck to overhang at least a portion of the first side edge of the second deck, the second surface of the first deck is in communication with the first surface of the second deck above an intersection of the first side edge of the second deck and the first surface of the second deck; thereby, permitting the rider to practice maintaining balance with the first deck so positioned and with the apparatus in motion.

BRIEF DESCRIPTION OF THE DRAWINGS

So the manner in which the above recited features are attained and can be understood in detail, a more detailed description is described below with reference to Figures illustrated in the appended drawings.

The Figures in the appended drawings, like the detailed description, are examples. As such, the Figures and the detailed description are not to be considered limiting, and other equally effective examples are possible and likely. Furthermore, like reference numerals in the Figures indicate like elements, and wherein.

DETAILED DESCRIPTION

In the following detailed description, numerous specific details are set forth in order to provide a thorough understanding of examples described herein. However, it will be understood that these examples may be practiced without the specific details. In other instances, well-known methods, procedures, components and circuits have not been described in detail, so as not to obscure the following description. Further, the examples disclosed are for exemplary purposes only and other examples may be employed in lieu of or in combination with of the examples disclosed.

As set forth in the summary above and described in more detail below, the following in directed to an apparatus for a rider of a sporting board, such as any of a skateboard, snowboard, wakeboard, mountain board, scooter, surfboard, etc., to practice maintaining a balance required for performing one or more tricks with the sporting board traveling over a given terrain. Examples of such tricks ("sporting-board tricks") may include any of a 180, 360, 5-O or ("five-0"), 50-50, Air, Airwalk Grab, Backside, Bail, Caballerial, Carving, Fakie, Frontside, Grabs, Grind, Heel Edge, Heelflip, Indy, Japan Air, Kickflip, Kickturns, Manual/Nose Manual, Method Air Grab, Nollie, Nosegrind, Ollie, Primo, Railstand, Rock and Roll, Stalefish, Toe Edge, Wheelies, Butters, Nose and Tail Rolls, Alley Oops, Backside 720 and the like.

Beneficially, the apparatus allows the rider to practice maintaining his or her (collectively "her") balance by allowing such rider, while the apparatus is in motion, to experience and adapt her center of gravity to one or more changes in orientation ("orientation changes") that occur during performance of such sporting-board tricks. To facilitate this, the rider is able to reconfigure the apparatus, on-the-fly, from one configuration to one or more other configurations to simulate the changes that occur during performance of the sporting-board tricks. For example, the rider may be able to reconfigure the apparatus from a first configuration, e.g., a neutral configuration, to a second configuration, e.g., a transverse configuration, to simulate the changes that occur during a transition to and carrying out a grind. Alternatively, the rider may be able to reconfigure the apparatus from the second configuration to the first configuration to simulate the changes that occur during a transition from the grind.

For the sake of simplicity, the following describes the apparatus in connection with performing one or more of the sporting-board tricks for a skateboard, even though the apparatus is equally applicable to any of a skateboard, snowboard, wakeboard, mountain board, scooter, surfboard and other like-type device. In addition, the apparatus may be used by the rider to practice maintaining the balance required for performing the sporting-board tricks other than those described above or below.

Example Architecture

Figure 1A:
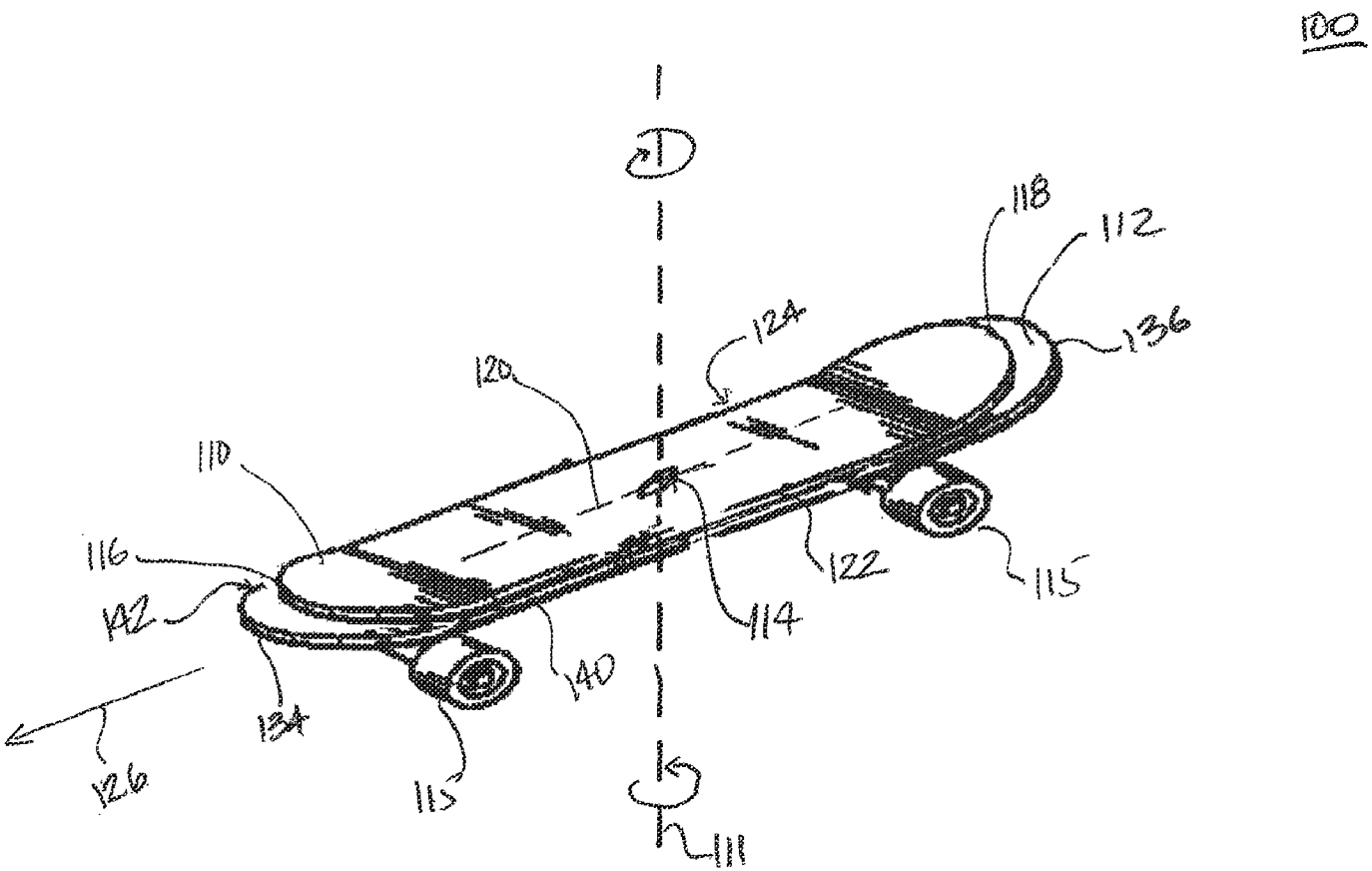
FIG. 1A is a block diagram illustrating an assembly view of an example apparatus for a rider to practice maintaining a balance required for performing sporting-board tricks.
Figure 1B:
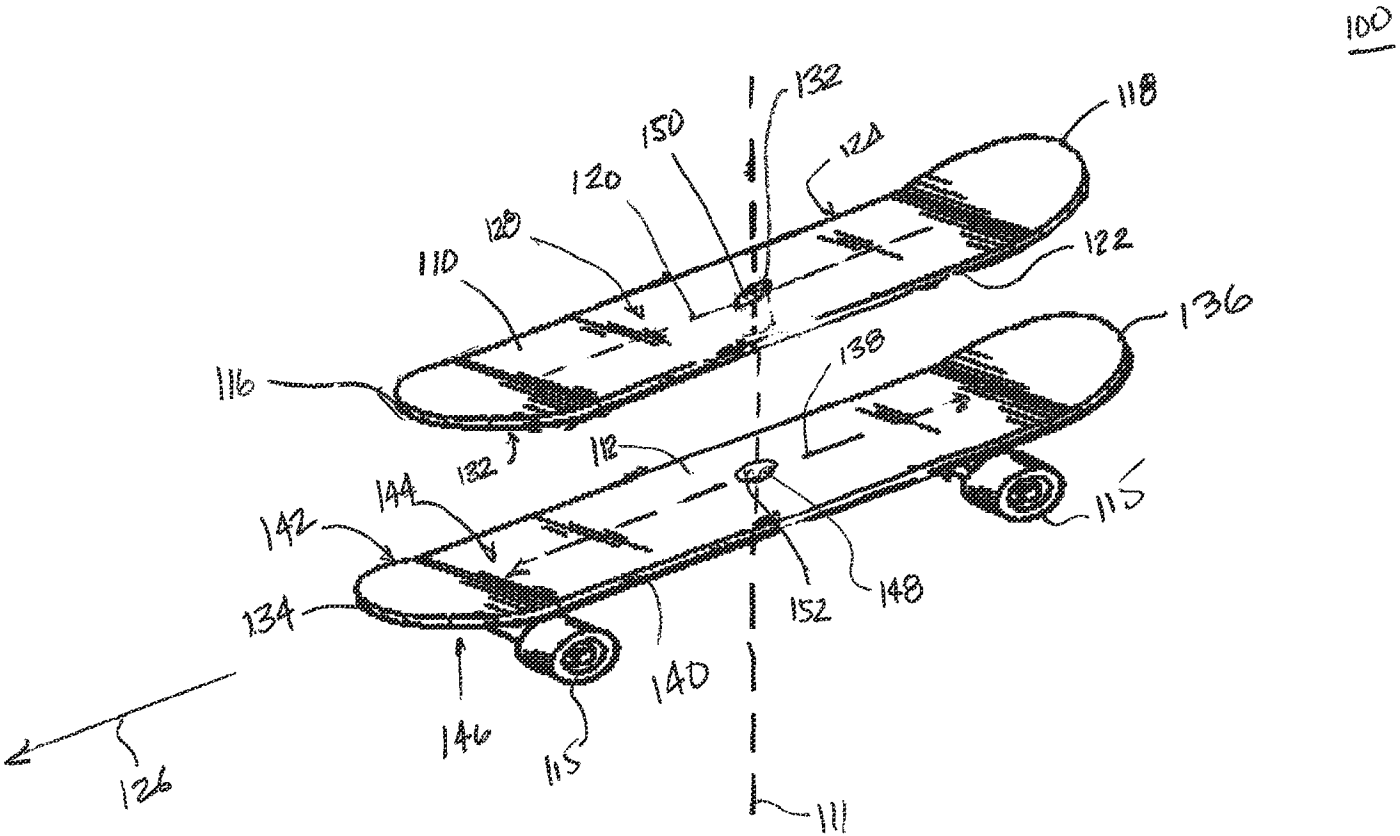
FIG. 1B is a block diagram illustrating an exploded view of an example apparatus for a rider to practice maintaining a balance required for performing sporting-board tricks.

Referring now to FIGS. 1A-1B, block diagrams illustrating an example apparatus 100 for a rider to practice maintaining a balance required to perform sporting-board tricks are shown. The block diagram of FIG. 1A illustrates an assembly view of the apparatus 100 in a first configuration, and the block diagram in FIG. 1B illustrates an exploded view of the apparatus 100 in the first configuration.

The apparatus 100 allows the rider, while the apparatus 100 is in motion, to experience and adapt her center of gravity to the orientation changes that occur during performance of the sporting-board tricks. To facilitate this, the apparatus 100 may include a first or "top" deck 110 positioned over a second or "bottom" deck 112; a pivot element 114 disposed in the top and bottom decks 110, 112; and a plurality of wheel assemblies 115

Figure 2:
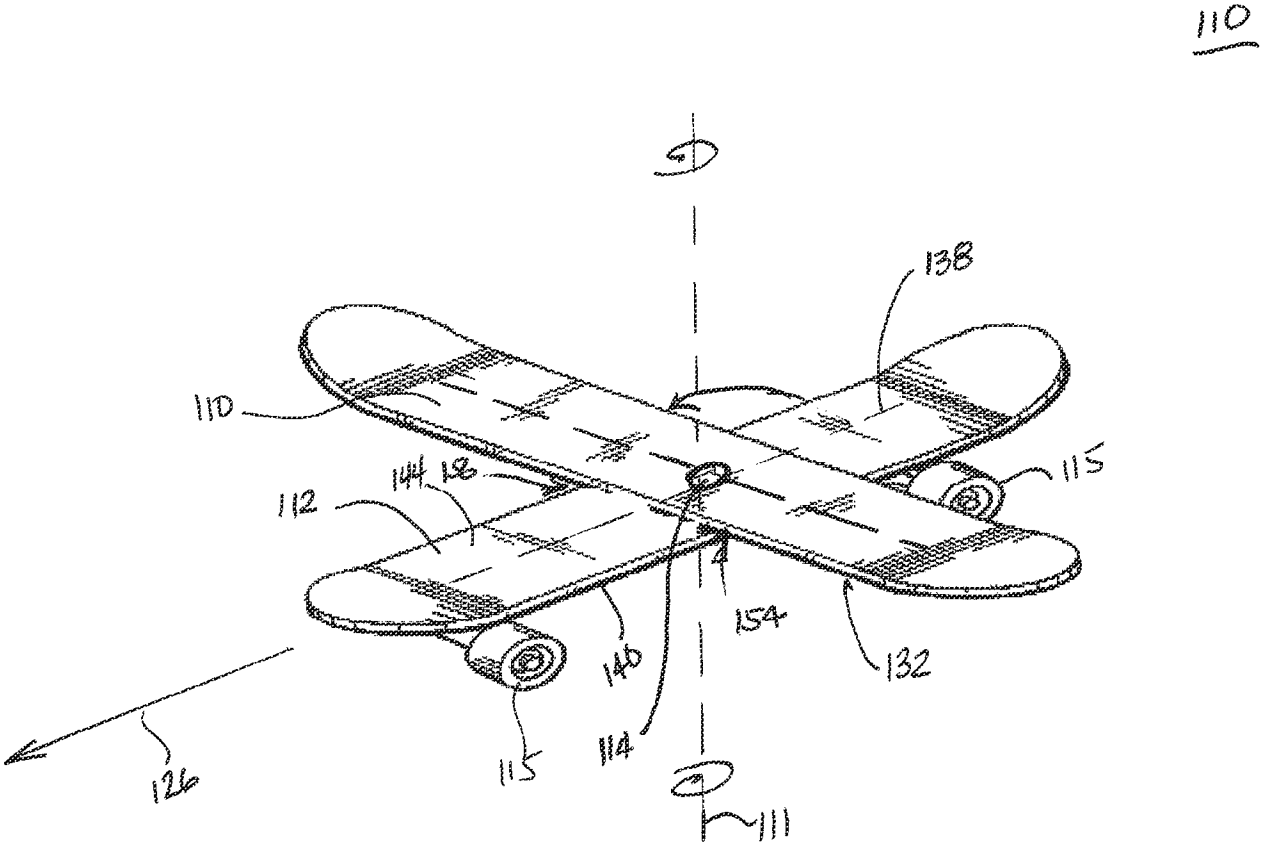
FIG. 2 is a block diagram illustrating an example apparatus for a rider to practice maintaining a balance required for performing sporting-board tricks.

The pivot element 114, as described in more detail below, allows the apparatus 100 to undergo reconfiguration from the first configuration to another configuration, such as is shown in FIG. 2, when the apparatus 100 is in motion. To facilitate this, the pivot element 114 is adapted to allow the first deck 110 to rotate horizontally about an axis 111, which is perpendicular to the second deck 112. The pivot element 114 may, for example, allow the first deck 110 to rotate horizontally about the axis 111 for less than, equal to and/or more than a full (i.e., three-hundred sixty degrees) rotation, and in either a clockwise or counter-clockwise direction.

The top deck 110 may include a nose ("top-deck-nose") end 116; a tail ("top-deck tail") end 118; and a first top-deck centerline 120 defined between the top-deck-nose and top-deck-tail ends 116, 118. The top deck 110 may also include first and second side edges 122, 124. In the first configuration, the first top-deck centerline 120, the first side ("top-deck-left") edge 122 and the second side ("top-deck-right") edge 124 are or are substantially aligned with a direction of travel 126. The top deck 110 may further include a first ("top-deck-upper") surface 128 onto which the rider may be positioned; a second ("top-deck-lower") surface 130; and a first ("top-deck") aperture 132 disposed between the top-deck-upper and top-deck-lower surfaces 128, 130. The top-deck aperture 132 is adapted for fixedly or un-fixedly retaining at least a portion of the pivot element 114.

The bottom deck 112 may include a nose ("bottom-deck-nose") end 134; a tail ("bottom-deck tail") end 136; and a first bottom-deck centerline 138 defined between the bottom-deck-nose and bottom-deck-tail ends 134, 136. The bottom deck 112 may also include first and second side edges 140, 142. In the first configuration, the first bottom-deck centerline 138, the first side ("bottom-deck-left") edge 140 and the second side ("bottom-deck-right") edge 142 are or are substantially aligned with the direction of travel 126, and in turn, with the first centerline 120.

The bottom deck 112 may further include a first ("bottom-deck-upper") surface 144; a second ("bottom-deck-lower") surface 146; and a second ("bottom-deck") aperture 148 disposed between the bottom-deck-upper and bottom-deck-lower surfaces 144, 146. The bottom-deck aperture 146 is adapted for fixedly retaining at least a portion of the pivot element 114.

The bottom deck 112 may also include details (not shown) adapted to retain the wheel assemblies 115 to the bottom-deck-lower surface 146. These wheel assemblies 115 may include one or more trucks, and ground-engaging wheels coupled to the trucks. The trucks may be adapted to mount to the bottom-deck-lower surface 146 using the details, and the ground-engaging wheels allow apparatus 100 to roll about on the ground.

As shown in FIG. 1A, at least a portion of the top-deck-lower surface 132 is in communication with the bottom-deck-upper surface 144. Typically, such communication between the top-deck-lower surface 132 and the bottom-deck-upper surface 144 is maintained by a first resistive force (e.g., friction or a keeper mechanism). This first resistive force may be at least sufficient to maintain alignment of the first top-deck centerline 120 and the first bottom-deck centerline 138 when the rider is positioned (e.g., goofy or regularly) on the top-deck-upper surface 128 and in proper balance for traveling in the direction of travel 126. The first resistive force may also be limited so that when the rider lessens her weight bearing down on the apparatus 100 (e.g., by elevating herself to cause the top deck 110 to separate from the bottom deck 112), the top deck 110 may be rotated about the axis 111.

To facilitate providing such first resistive force, either or both of the top-deck-lower surface 132 and the bottom-deck-upper surface 144 may be coated with, have disposed thereon or otherwise formed with materials, such as friction tape, sand, etc., that prevent the first and second decks 110, 112 from changing alignment. In addition, the pivot element 114 is adapted to allow a given amount of separation between the top-deck-lower surface 132 and the bottom-deck-upper surface 144. This way, the pivot element 114 allow for reconfiguration of the apparatus 100 to and/or from the first configuration.

The pivot element 114 may include a first part 150 and a second part 152. The first pivot part 150 may be disposed in the top-deck aperture 132 and fixedly attached to top deck 110. Alternatively, the first pivot part 150 may be formed, at least in part, from surfaces of the top deck 110 surrounding and/or adjacent to the top-deck aperture 120. The first pivot part 150 is adapted to rotate about the axis 111, and allow the top deck 110 to separate from the lower deck 112 and to rotate about the axis 111.

The second pivot part 152 may be disposed in the bottom-deck aperture 148, and fixedly attached to the bottom deck 112. Alternatively, the second pivot part 152 may be formed, at least in part, from surfaces of the bottom deck 112 surrounding and/or adjacent to the bottom-deck aperture 148. The second pivot part 152 is adapted to allow the first pivot part 150 rotate about the axis 111. To facilitate this, the second pivot part 152 may have an outer surface; at least a portion of which is affixed to the bottom deck 112. The second pivot part 152 may also have an inner surface, e.g., a bearing surface. This bearing surface is adapted to accept the first pivot part 150. Examples of the pivot element 114 include any of nut and bolt combination, a ball joint and the like.

FIG. 2 is a block diagram illustrating the example apparatus 100 in a second configuration. In this second configuration, the top deck 110 is positioned traverse to the bottom deck centerline 138 such that at least a portion of the top deck 110 overhangs at least a portion of the bottom-deck-left edge 140 and the bottom-deck-right edge 142. In addition, the top-deck-lower, surface 132 is in communication with the bottom-deck-upper surface 144 at one or more locations between first and second intersections 154, 156. The first intersection 154 occurs at an intersection of the bottom-deck-left edge 140 and the top-deck-lower surface 132. The second intersection 156 occurs at an intersection of the bottom-deck-right edge 140 and the top-deck-lower surface 132.

Typically, the communication between the top-deck-lower surface 132 and the bottom-deck-upper surface 144 is maintained by a second resistive force. This second resistive force may be at least sufficient to maintain a traverse alignment between the first top-deck centerline 120 and the first bottom-deck centerline 138 when the rider is positioned on the top-deck-upper surface 128 and in proper balance for traveling in the direction of travel 126. The second resistive force may also be limited so that when the rider lessens her weight bearing down on the apparatus 100 (e.g., by to cause the top deck 110 to separate from the bottom deck 112), the top deck 110 may be rotated about the axis 111 (in a clockwise or counterclockwise direction).

To facilitate providing such second resistive force, either or both of the top-deck-lower surface 132 and the bottom-deck-upper surface 144 may be coated with, have disposed thereon or otherwise formed with materials, such as friction tape, sand, etc., that prevent the first and second decks 110, 112 from changing alignment. In addition, the pivot element 114 is adapted to allow a given amount of separation between the top-deck-lower surface 132 and the bottom-deck-upper surface 144. This way, the pivot element 114 allows for reconfiguration of the apparatus 100 to and/or from the second configuration.

Although the second configuration of the apparatus 100, as shown in FIG. 2, illustrates the top deck 110 being positioned traverse to the bottom deck centerline 138, the top deck 110 may be positioned at any angle to the bottom deck centerline 138 that causes the top deck 110 to not be in alignment with the bottom deck 112. This way, the apparatus 100, in the second configuration, may be arranged to mimic any number of orientations that occur during performance of the sporting-board tricks.

Example Operation

In operation, the rider may mount the apparatus 100 in the first configuration by positioning herself (e.g., placing one or both of her feet) on the top-deck-upper surface 128 and properly applying her weight to the apparatus 100 (as translated through the communication between the top deck 110 and bottom deck 112). After mounting the apparatus 100, the rider may accelerate in the travel direction 126 (e.g., by "peddling" or taking advantage of a decline in the given terrain) so as to allow for the apparatus 100 to reach a given speed.

After reaching the given speed, the rider may reposition herself (e.g., in goofy or standard form) on the top-deck-upper surface 128 and properly reapply her weight to the apparatus 100 to attain a first balance for controlling the apparatus 100 in the first configuration as it travels over one or more changes in the given terrain. The rider may periodically and/or continually reposition and reapply or shift her weight to maintain the first balance while traveling over the given terrain. In addition, the rider may periodically reposition herself and properly reapply her weight to maintain the apparatus 100 at given speed.

After the attaining and/or maintaining the first balance, the rider may cause the reconfiguration of the apparatus 100 from the first configuration to the second configuration. To do this, the rider may reduce the first resistive force, and cause the upper deck 110 to pivot about the axis 111 via the pivot element 114. The rider may reduce the first resistive force by, for example, causing the separation between the top-deck-lower surface 132 and the bottom-deck-upper surface 144. To facilitate such separation, the rider may jump vertically while maintaining contact with the top-deck-upper surface 128 (as is common with many of the sporting-board tricks).

To cause the upper deck 110 to pivot about the axis 111, the rider may rotate her body in accordance with the angle between the top deck centerline 120 and the bottom deck centerline 138 that results from the change to the second configuration. During this change, the pivot element 114 acts as a pivot point and maintains a vertical alignment between the first and second decks 110, 112. To facilitate this, the first pivot part 150 allows the top deck 110 to separate from the lower deck 112 and rotate about the axis 111 and the second pivot part 152 allows the first pivot part 150 rotate about the axis 111, pursuant to the bearing surfaces of the second pivot part 152.

As a result of the reconfiguration, the rider experiences and may adapt her center of gravity to the orientation changes that occur during performance of the sporting-board tricks that are commensurate with transitioning to and/or being in the second configuration of the apparatus 100 traveling over the given terrain. As noted above, in the second configuration, the top deck 110 and the bottom deck 112 may be arranged to mimic any number of orientations that occur during performance of the sporting-board tricks.

When properly adapting her center of gravity to the orientation changes, the rider may attain and/or maintain a second balance for controlling the apparatus 100 in the second configuration as it travels over one or more changes in the given terrain. As is common with practicing the sporting-board tricks, the rider may have to make several attempts to properly adapt her center of gravity to attain and/or maintain the second balance. The rider may make the attempts by repeating some or all of the foregoing operation.

After transitioning to the second configuration (whether or not attaining the second balance), the rider may maintain the apparatus 100 in such configuration for a period of time and/or stop (or cause the stop of) the apparatus 100 from continuing to travel. Alternatively and/or additionally, the rider may cause the reconfiguration of the apparatus 100 from the second configuration to the first configuration.

Analogous to above, the rider may do this by reducing the second resistive force, and causing the upper deck 110 to pivot about the axis 111 via the pivot element 114 to place the apparatus in the first configuration. The rider may reduce the second resistive force by, for example, causing the separation between the top-deck-lower surface 132 and the bottom-deck-upper surface 144. To facilitate such separation, the rider may jump vertically while maintaining contact with the top-deck-upper surface 128 (as is common with many of the sporting-board tricks).

To cause the upper deck 110 to pivot about the axis 111, the rider may rotate her body in accordance with the angle between the top deck centerline 120 and the bottom deck centerline 138 that results from the change to the first configuration. During this change, the pivot element 114 acts as a pivot point and maintains a vertical alignment between the first and second decks 110, 112. To facilitate this, the first pivot part 150 allows the top deck 110 to separate from the lower deck 112 and rotate about the axis 111 and the second pivot part 152 allows the first pivot part 150 rotate about the axis 111, pursuant to the bearing surfaces of the second pivot part 152.

As a result of the reconfiguration to the first configuration, the rider experiences and may adapt her center of gravity to the orientation changes that occur during performance of the sporting-board tricks that are commensurate with the transitioning to and/or being in the first configuration of the apparatus 100 traveling over the given terrain. In the first configuration, the top deck 110 and the bottom deck 112 are arranged to mimic a starting, returning or neutral orientation that occur during performance of the sporting-board tricks.

When properly adapting her center of gravity to the orientation changes, the rider may attain and/or maintain a third balance for controlling the apparatus 100 in the first configuration as it travels over one or more changes in the given terrain. As is common with practicing the sporting-board tricks, the rider may have to make several attempts to properly adapt her center of gravity to attain and/or maintain the third balance. The rider may make the attempts by repeating some or all of the foregoing operation.

After transitioning to the first configuration (whether or not attaining the third balance), the rider may maintain the apparatus 100 in such configuration for a period of time and/or stop (or cause the stop of) the apparatus 100 from continuing to travel. Alternatively and/or additionally, the rider may cause one or more repetitions of the reconfiguration of the apparatus 100 from the first configuration to the second configuration and back to the first configuration.

Alternative Architecture

Figure 3A:
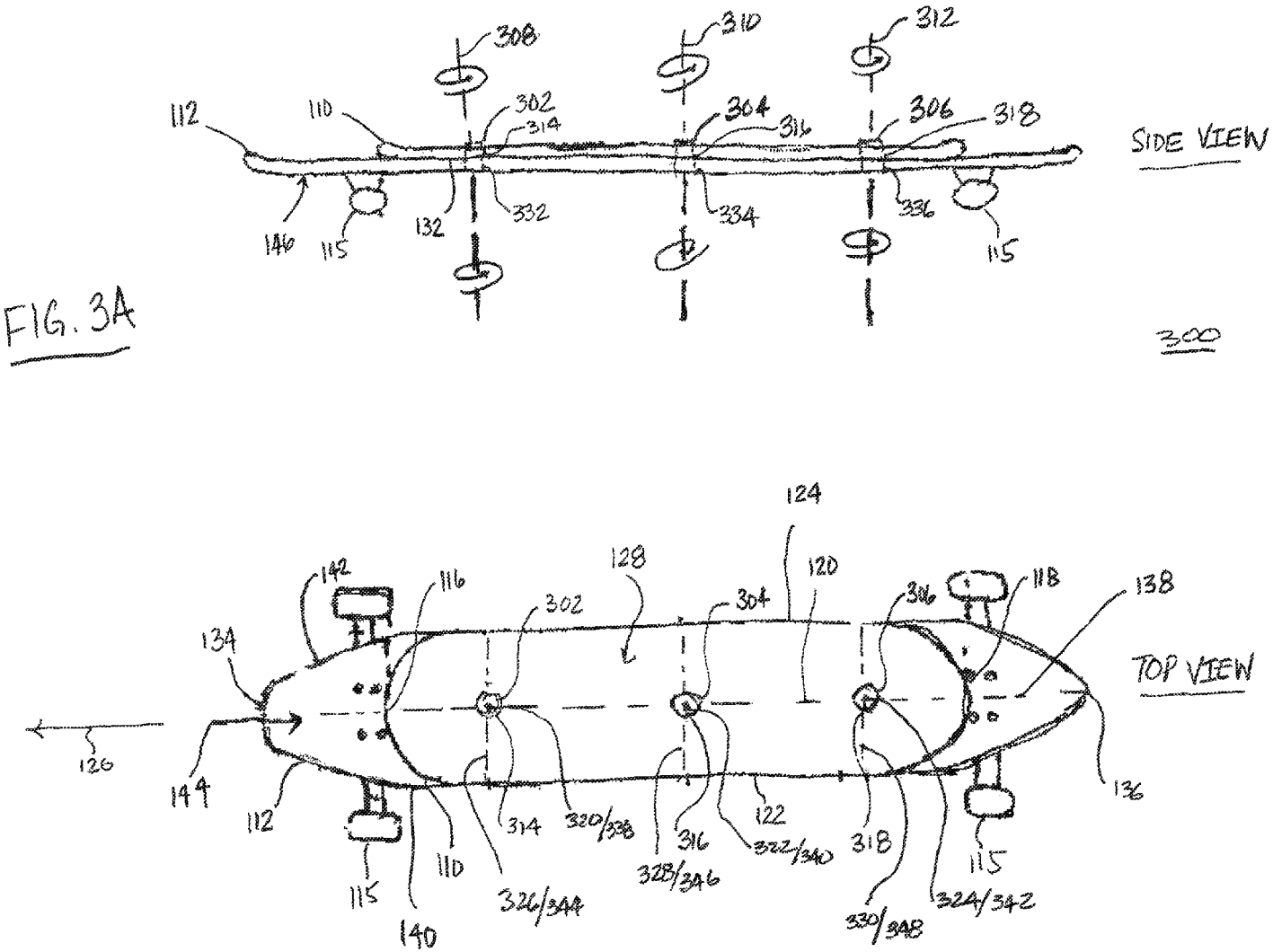
FIG. 3A is a block diagram illustrating top and side views of an example apparatus for a rider to practice maintaining a balance required for performing sporting-board tricks.
Figure 3B:
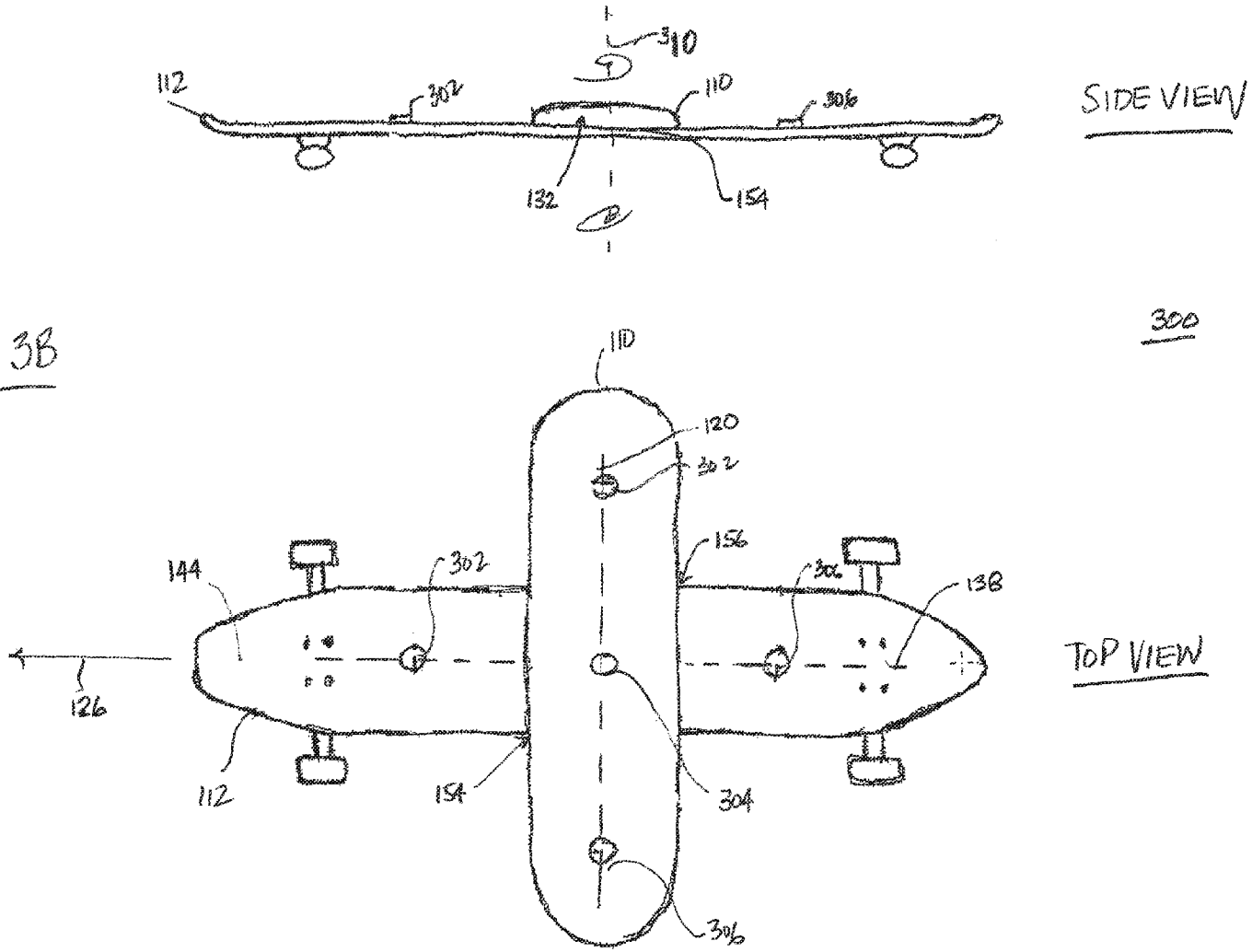
FIG. 3B is block diagram illustrating top and side views of an example apparatus for a rider to practice maintaining a balance required for performing sporting-board tricks.
Figure 3C:
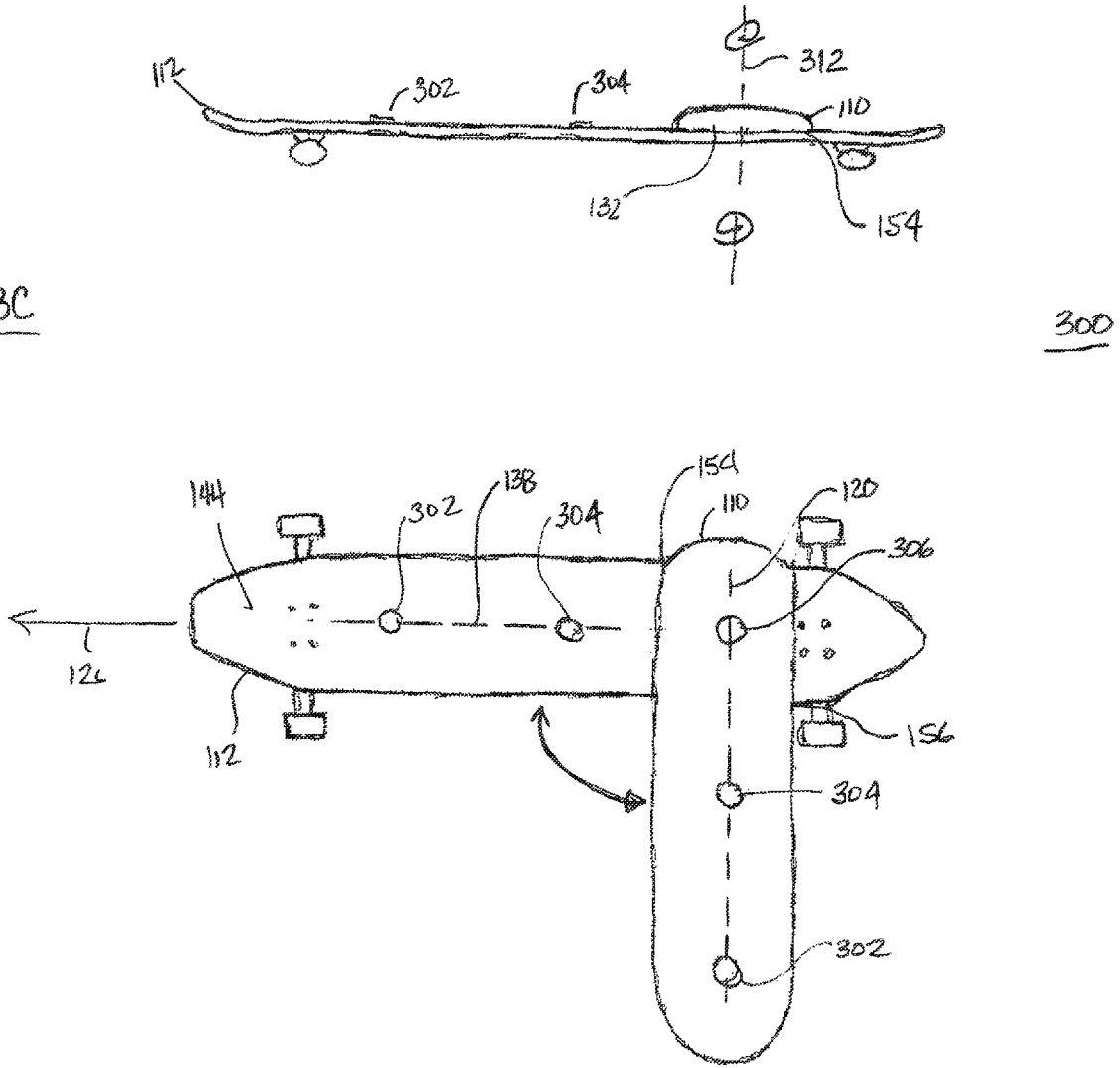
FIG. 3C is block diagram illustrating top and side views of an example apparatus for a rider to practice maintaining a balance required for performing sporting-board tricks.

FIGS. 3A-3C are block diagrams illustrating an example apparatus 300 for a rider to practice maintaining a balance required for performing sporting-board tricks. The apparatus 300 of FIGS. 3A-3C is similar to the apparatus 100 of FIGS. 1A-1B and 2, except as described herein. The block diagram of FIG. 3A illustrates top and side views of the apparatus 300 in a first configuration. The block diagram of FIG. 3B illustrates top and side views of the apparatus 300 in a second configuration. And the block diagram of FIG. 3C illustrates top and side views of the apparatus in a third configuration.

Analogous to the apparatus 100, the apparatus 300 allows the rider, while the apparatus 300 is in motion, to experience and adapt her center of gravity to the orientation changes that occur during performance of the sporting-board tricks. To facilitate this, the apparatus 300 may include the top deck 110 positioned over bottom deck 112; a plurality of wheel assemblies 115; and first, second and third pivot elements 302, 304 and 306 disposed in the top and bottom decks 110, 112.

Each of the pivot elements 302, 304 and 306, as described in more detail below, allows the apparatus 300 to undergo reconfiguration from the one of the first, second and third configurations to another one of such configurations when the apparatus 300 is in motion. To facilitate this, the pivot elements 302, 304 and 306 are adapted to allow the first deck 110 to rotate horizontally about respective first, second and third axes 308, 310 and 312; each of which is perpendicular to the second deck 112. The pivot elements 302, 304 and 306 may, for example, allow the first deck 110 to rotate horizontally about the first, second and third axes 308, 310 and 312, respectively, for less than, equal to and/or more than a full rotation. The pivot elements 302, 304 and 306 may allow such rotation in either a clockwise or counter-clockwise direction.

With reference to FIG. 3A, the top deck 110 may include the top-deck-nose end 116, top-deck tail end 118, first top-deck centerline 120, top-deck-left edge 122, top-deck-right edge 124, top-deck-upper surface 128 and top-deck-lower surface 130. In the first configuration, the first top-deck centerline 120, top-deck-left edge 122 and top-deck-right edge 124 are or are substantially aligned with a direction of travel 126.

The top deck 110 may further include first, second and third ("top-deck") apertures 314, 316 and 318; first, second and third ("top-deck-aperture") centerlines 320, 322 and 324; and first, second and third ("top-deck-traverse") centerlines 326, 328 and 330. The first, second and third top-deck-aperture centerlines 320, 322 and 324 define vertical centers of the first, second and third top-deck apertures 314, 316 and 318.

The first, second and third top-deck-traverse centerlines 326, 328 and 326 define centerlines that are positioned between the top-deck-right and top-deck-left edges 122, 124, respectively. These first, second and third top-deck-traverse centerlines 326, 328 and 326 may be positioned in any number of locations in the top deck 110. For example, the second top-deck-traverse centerline 328 may be positioned halfway between the top-deck-nose and top-deck-tail ends 116, 118. The first top-deck-traverse centerline 326 may be positioned at a first given distance from the second top-deck-traverse centerline 328 toward the top-deck-nose end 116. This first given distance may be, for example, halfway between the top-deck-nose end 116 and the second top-deck-traverse centerline 328. The third top-deck-traverse centerline 330 may be positioned at a second given distance from the second top-deck-traverse centerline 328 toward the top-deck-tail end 118. The second given distance may be, for example, halfway between the top-deck-tail end 118 and the second top-deck-traverse centerline 328. The first and second given distances may be other distances as well.

The first, second and third top-deck apertures 314, 316 and 318 are disposed between the top-deck-upper and top-deck-lower surfaces 128, 130. The first, second and third top-deck-traverse apertures 314, 316 and 318 may be positioned in any number of locations in the top deck 110. For example, the first top-deck aperture 314 may be positioned such that the first top-deck-aperture centerline 320 is located at or approximately at a first intersection between the first top-deck centerline 120 and the first top-deck-traverse centerline 326. The second top-deck aperture 316 may be positioned such that the second top-deck-aperture centerline 322 is located at or approximately at a second intersection between the first top-deck centerline 120 and the second top-deck-traverse centerline 328. The third top-deck aperture 316 may be positioned such that the third top-deck-aperture centerline 324 is located at or approximately at a third intersection between the first top-deck centerline 120 and the third top-deck-traverse centerline 330.

The first, second and third top-deck apertures 314, 316 and 318 are adapted for retaining at least a portion of the pivot elements 302, 304 and 306. For example, the first, second and third top-deck apertures 314, 316 and 318 may include details for fixedly coupling at least a portion of the pivot elements 302, 304 and 306. Alternatively and/or additionally, the first, second and third top-deck apertures 314, 316 and 318 may retain, without fixedly coupling, at least a portion of the pivot elements 302, 304 and 306.

The bottom deck 112 may include the bottom-deck-nose end 134, bottom-deck tail end 136, bottom-deck-left edge 140, bottom-deck-right edge 142, first bottom-deck centerline 138, bottom-deck-upper surface 144, bottom-deck-lower surface 146. In the first configuration, the first bottom-deck centerline 138, bottom-deck-left edge 140 and bottom-deck-right edge 142 are or are substantially aligned with the direction of travel 126, and in turn, with the first centerline 120.

The bottom deck 112 may also include details (not shown) adapted to retain the wheel assemblies 115 to the bottom-deck-lower surface 146. These wheel assemblies 115 may include one or more trucks, and ground-engaging wheels coupled to such trucks. The trucks may be adapted to mount to the bottom-deck-lower surface 146 using the details, and the ground-engaging wheels allow apparatus 300 to roll about on the ground.

The bottom deck 112 may further include first, second and third ("bottom-deck") apertures 332, 334 and 336; first, second and third ("bottom-deck-aperture") centerlines 338, 340 and 342; and first, second and third ("bottom-deck-traverse") centerlines 344, 346 and 348. The first, second and third bottom-deck-aperture centerlines 338, 340 and 342 define vertical centers of the first, second and third bottom-deck apertures 332, 334 and 336.

The first, second and third bottom-deck-traverse centerlines 344, 346 and 348 define centerlines that are positioned between the bottom-deck-right and bottom-deck-left edges 140, 142, respectively. These first, second and third bottom-deck-traverse centerlines 344, 346 and 348 may be positioned in any number of locations in the bottom deck 112. For example, the second bottom-deck-traverse centerline 346 may be positioned halfway between the bottom-deck-nose and bottom-deck-tail ends 134, 136. The first bottom-deck-traverse centerline 344 may be positioned at a third given distance from the second bottom-deck-traverse centerline 344 toward the bottom-deck-nose end 134. This third given distance may be, for example, halfway between the top-deck-nose end 116 and the second top-deck-traverse centerline 328. The third bottom-deck-traverse centerline 348 may be positioned at a fourth given distance from the second bottom-deck-traverse centerline 346 toward the bottom-deck-tail end 136. The fourth given distance may be, for example, halfway between the top-deck-tail end 118 and the second top-deck-traverse centerline 328. The third and fourth given distances may be other distances as well.

The first, second and third bottom-deck apertures 332, 334 and 336 are disposed between the bottom-deck-upper and bottom-deck-lower surfaces 144, 146. The first, second and third bottom-deck-traverse apertures 332, 334 and 336 may be positioned in any number of locations in the bottom deck 112. For example, the first bottom-deck aperture 332 may be positioned such that the first bottom-deck-aperture centerline 338 is located at or approximately at a fourth intersection between the first bottom-deck centerline 138 and the first bottom-deck-traverse centerline 346. The second bottom-deck aperture 334 may be positioned such that the second bottom-deck-aperture centerline 344 is located at or approximately at a fifth intersection between the first bottom-deck centerline 138 and the second bottom-deck-traverse centerline 346. The third bottom-deck aperture 336 may be positioned such that the third bottom-deck-aperture centerline 342 is located at or approximately at a sixth intersection between the first bottom-deck centerline 138 and the third bottom-deck-traverse centerline 348.

The first, second and third bottom-deck apertures 332, 334 and 336 are adapted for retaining at least a portion of the pivot elements 302, 304 and 306. For example, the first, second and third bottom-deck apertures 332, 334 and 336 may include details for fixedly coupling at least a portion of the pivot elements 302, 304 and 306. Alternatively and/or additionally, the first, second and third bottom-deck apertures 332, 334 and 336 may retain, without fixedly coupling, at least a portion of the pivot elements 302, 304 and 306.

As shown in FIG. 3A, at least a portion of the top-deck-lower surface 132 is in communication with the bottom-deck-upper surface 144. Typically, such communication between the top-deck-lower surface 132 and the bottom-deck-upper surface 144 is maintained by a third resistive force (e.g., friction or a keeper mechanism). This third resistive force may be at least sufficient to maintain alignment of the first top-deck centerline 120 and the first bottom-deck centerline 138 when the rider is positioned (e.g., goofy or regularly) on the top-deck-upper surface 128 and in proper balance for traveling in the direction of travel 126. The third resistive force may also be limited so that when the rider lessens her weight bearing down on the apparatus 300 (e.g., by elevating herself to cause the top deck 110 to separate from the bottom deck 112), the top deck 110 may be rotated about any of the axes 308, 310 and 312.

To facilitate providing such third resistive force, either or both of the top-deck-lower surface 132 and the bottom-deck-upper surface 144 may be coated with, have disposed thereon or otherwise formed with materials, such as friction tape, sand, etc., that prevent the first and second decks 110, 112 from changing alignment. In addition, each of the pivot elements 302, 304 and 306 is adapted to allow a given amount of separation between the top-deck-lower surface 132 and the bottom-deck-upper surface 144. This way, the pivot elements 302, 304 and 306 allow for reconfiguration of the apparatus 300 among any of the first, second and third configurations.

Although not shown, the pivot elements 302, 304 and 306 may include respective arrangements having first and second parts. The first pivot parts may be disposed in their respective first, second and third top-deck apertures 320, 322 and 324 and fixedly attached to top deck 110. Alternatively, the first pivot parts 302, 304 and 306 may be formed, at least in part, from surfaces of the top deck 110 surrounding and/or adjacent to the first, second and third top-deck apertures 320, 322 and 324. The first pivot parts are adapted to rotate about the axes 308, 310 and 312, respectively, and allow the top deck 110 to separate from the lower deck 112 and to rotate about the axes 308, 310 and 312.

The second pivot parts may be disposed in their respective first, second and third bottom-deck apertures 332, 334 and 336, and fixedly attached to the bottom deck 112. Alternatively, the second pivot parts may be formed, at least in part, from surfaces of the bottom deck 112 surrounding and/or adjacent to the first, second and third bottom-deck apertures 332, 334 and 336. The second pivot parts are adapted to allow the first pivot parts rotate about the axes 308, 310 and 312. To facilitate this, each of the second pivot parts may have an outer surface; at least a portion of which is affixed to the bottom deck 112. The second pivot parts may also have respective inner surfaces, e.g., bearing surfaces. These bearing surfaces are adapted to accept the first pivot parts. Examples of the each of the pivot elements 302, 304 and 306 include any of nut and bolt combination, a ball joint and the like.

FIG. 3B is a block diagram illustrating the example apparatus 300 in the second configuration. In this second configuration, the top deck 110 is positioned traverse to the bottom deck centerline 138 via the second pivot element 304 such that at least a portion of the top deck 110 overhangs at least a portion of the bottom-deck-left edge 140 and the bottom-deck-right edge 142. As above, the top-deck-lower surface 132 is in communication with the bottom-deck-upper surface 144 at one or more locations between the first and second intersections 154, 156.

Typically, the communication between the top-deck-lower surface 132 and the bottom-deck-upper surface 144 is maintained by a fourth resistive force. This fourth resistive force may be at least sufficient to maintain a traverse alignment between the first top-deck centerline 120 and the first bottom-deck centerline 138 via the third pivot element 306 when the rider is positioned on the top-deck-upper surface 128 and in proper balance for traveling in the direction of travel 126. The fourth resistive force may also be limited so that when the rider lessens her weight bearing down on the apparatus 300 (e.g., by to cause the top deck 110 to separate from the bottom deck 112), the top deck 110 may be rotated about the third axis 312 (in a clockwise or counterclockwise direction).

To facilitate the rotation, the second pivot element 304 is adapted to allow a given amount of separation between the top-deck-lower surface 132 and the bottom-deck-upper surface 144. In addition, each of the first and third pivot elements 302, 306 may be removed. Alternatively, each of the first and third pivot elements 302, 306 may be adapted to separate into their respective first and second parts. For example, the first and second parts may include keyed couplers that, responsive to an impetus (e.g., a pushing and/or twisting action), cause the first and second parts to separate. This way, the second pivot element 304 allows for reconfiguration of the apparatus 300 to and/or from the second configuration.

Although the second configuration of the apparatus 300, as shown in FIG. 3B, illustrates the top deck 110 being positioned traverse to the bottom deck centerline 138, the top deck 110 may be positioned at any angle to the bottom deck centerline 138 that causes the top deck 110 to not be in alignment with the bottom deck 112. This way, the apparatus 300, in the second configuration, may be arranged to mimic any number of orientations that occur during performance of the sporting-board tricks.

Referring now to FIG. 3C, a block diagram illustrating the example apparatus 300 in the third configuration is shown. In this third configuration, the top deck 110 is positioned traverse to the bottom deck centerline 138 via the third pivot element 306 such that at least a portion of the top deck 110 overhangs at least a portion of the bottom-deck-left edge 140 and the bottom-deck-right edge 142. As above, the top-deck-lower surface 132 is in communication with the bottom-deck-upper surface 144 at one or more locations between the first and second intersections 154, 156.

Typically, the communication between the top-deck-lower surface 132 and the bottom-deck-upper surface 144 is maintained by a fifth resistive force. This fifth resistive force may be at least sufficient to maintain a traverse alignment between the first top-deck centerline 120 and the first bottom-deck centerline 138 via the third pivot element 306 when the rider is positioned on the top-deck-upper surface 128 and in proper balance for traveling in the direction of travel 126. The fifth resistive force may also be limited so that when the rider lessens her weight bearing down on the apparatus 300 (e.g., by to cause the top deck 110 to separate from the bottom deck 112), the top deck 110 may be rotated about the axis 312 (in a clockwise or counterclockwise direction).

To facilitate the rotation, the third pivot element 306 is adapted to allow a given amount of separation between the top-deck-lower surface 132 and the bottom-deck-upper surface 144. In addition, each of the first and second pivot elements 302, 304 may be removed and/or adapted to separate into their respective first and second parts. This way, the third pivot element 306 allows for reconfiguration of the apparatus 300 to and/or from the third configuration.

Although the third configuration of the apparatus 300, as shown in FIG. 3C, illustrates the top deck 110 being positioned traverse to the bottom deck centerline 138, the top deck 110 may be positioned at any angle to the bottom deck centerline 138 that causes the top deck 110 to not be in alignment with the bottom deck 112. In this way, the apparatus 300, in the third configuration, may be arranged to mimic any number of orientations that occur during performance of the sporting-board tricks.

As one of ordinary skill in the art will recognize, the apparatus 300 may be configured into a fourth configuration. The fourth configuration differs from the third configuration in that the top deck 110 is positioned traverse to the bottom deck centerline 138 via the first pivot element 302. Also, one of ordinary skill in the art will recognize that the rider may operate the apparatus 300 in much the same way as operating the apparatus 100, as described above. Analogous to the operation of the apparatus 100, the rider may operate the apparatus 300 to experience and adapt her center of gravity to the orientation changes that occur during performance of the sporting-board tricks that are commensurate with transitioning to, transitioning from and/or being in any of the first, second, third and fourth configurations of the apparatus 300 while traveling over the given terrain. In any of the first, second, third and fourth configurations, the top deck 110 and the bottom deck 112 may be arranged to mimic any number of orientations that occur during performance of the sporting-board tricks.

Figure 4A:
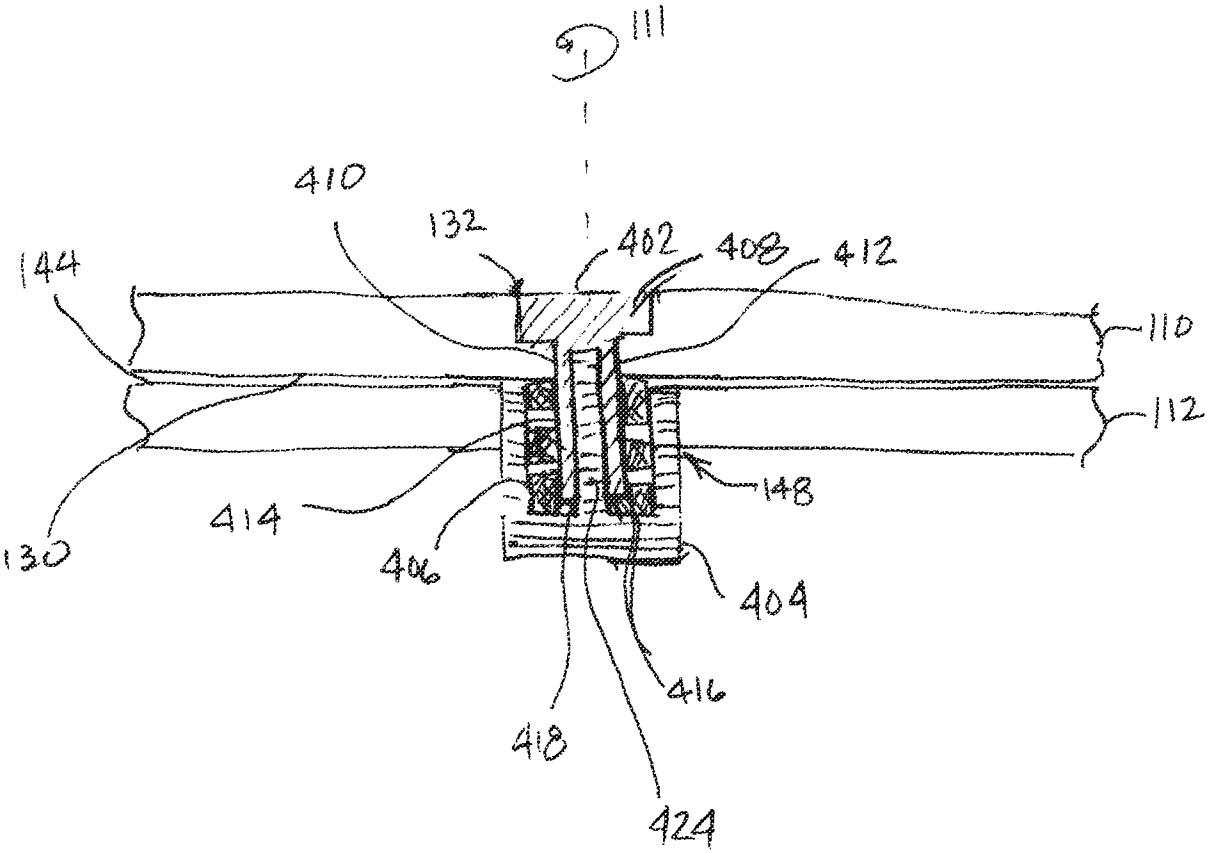
FIGS. 4A-4B are block diagrams illustrating an example pivot element for an apparatus for a rider to practice maintaining a balance required for performing sporting-board tricks.
Figure 4B:
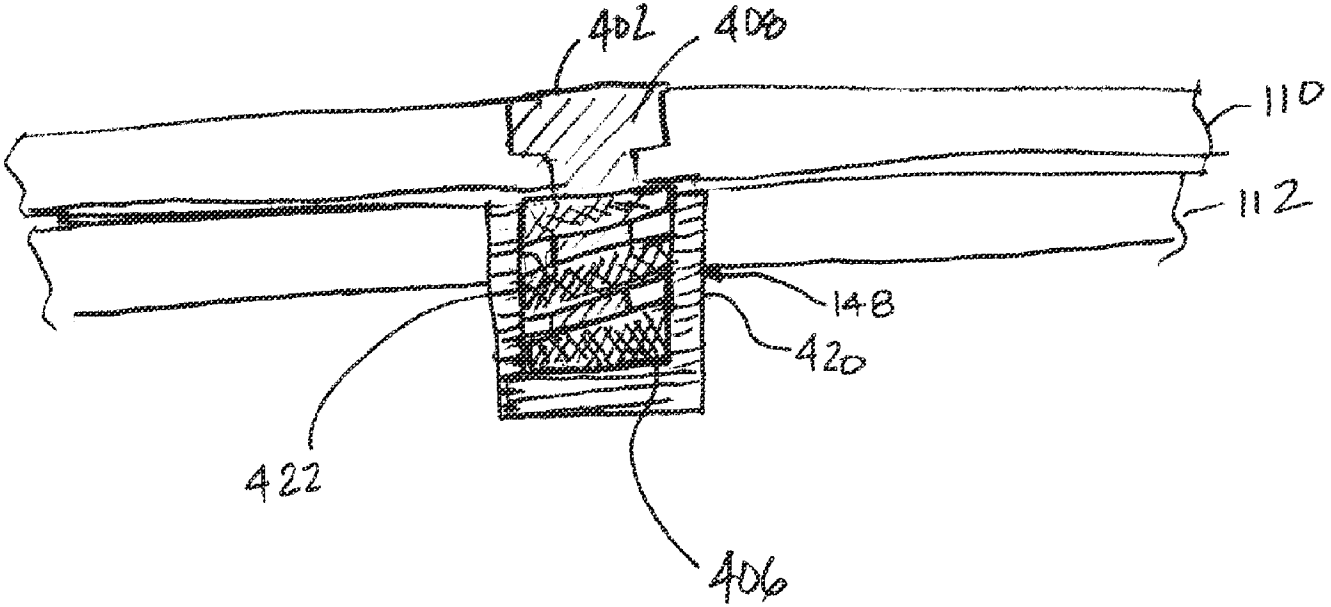

FIGS. 4A-4B are block diagrams illustrating an example pivot element 400 for an apparatus for a rider to practice maintaining a balance required for performing sporting-board tricks. The block diagrams of FIGS. 4A and 4B illustrate two cross-sectional views, respectively, of the example pivot element 400 disposed in the apparatus of FIG. 1. For convenience, the pivot element 400 of FIGS. 4A and 4B is similar to the pivot element 114 of FIG. 1, except as described herein.

The pivot element 400 includes a first, second and third pivot parts 402, 404 and 406. The first pivot part 402 may be disposed in the top-deck aperture 132. The first pivot part 402 is adapted to allow the top deck 110 to rotate about the axis 111, and allow the top deck 110 to separate from the lower deck 112. To facilitate this, the first pivot part 402 may include a head part 408 and a shaft part ("first-pivot-part shaft") 410. The head part 408 and/or at least a first portion 412 of the first-pivot-part shaft 410 may be fixedly or removably (e.g., by threads) attached to the top deck 110. At least a second portion 414 of the first-pivot-part shaft 410 extends from the top deck 110 through the bottom deck 112 via the second pivot part 404. The first-pivot-part shaft 410 also includes a tubular portion 416 extending a given distance from an aperture 418 of the first-pivot-part shaft 410 towards the head part 402. The given distance may be a function of a desired amount of separation between the top-deck-lower surface 130 and the bottom-deck-upper surface 144 to allow the apparatus 100 to undergo reconfiguration.

The second pivot part 404 may be disposed in the bottom-deck aperture 148, and fixedly or removably (e.g., by threads) attached to the bottom deck 112. Alternatively, the second pivot part 404 may be formed, at least in part, from surfaces of the bottom deck 112 surrounding and/or adjacent to the bottom-deck aperture 148. The second pivot part 404 is adapted to allow the first pivot part 150 rotate about the axis 111. To facilitate this, the second pivot part 404 may have an outer surface 420; at least a portion of which is affixed to the bottom deck 112. The second pivot part 404 may also have an inner surface 422. This inner surface 422 may be, for example, a bearing surface. The second pivot part 404 may also include a shaft part ("second-pivot-part shaft") 424 that is adapted to fit within the tubular portion 416 of the first-pivot-part shaft 410.

The third pivot part 406 may be a spring or other spring-like device that is disposed about or otherwise around the second portion 414 of the first-pivot-part shaft 410 that passes through the bottom deck 112 via the second pivot part 404. The third pivot part 406 may be retained about such second portion 416 of the shaft part 410 by top-deck-lower surface 130 and the inner surface 422 of the second pivot part 402. The third pivot part 406 may be under compression or in a compressed state when the rider bears down on the top deck 110 of apparatus 100. Conversely, when the rider lessens her weight bearing down on the top deck 110 of the apparatus 100, the third pivot part 406 expand from the compressed state causing the top deck 100 to separate from the bottom deck 112 so as to allow reconfiguration of the apparatus 100.

CONCLUSION

Variations of the method, apparatus and system described above are possible without departing from the scope of the invention. In view of the wide variety of embodiments that can be applied, it should be understood that the illustrated embodiments are exemplary only, and should not be taken as limiting the scope of the following claims.

The foregoing description of preferred embodiments of the present invention provides illustration and description, but is not intended to be exhaustive or to limit the invention to the precise form disclosed. Modifications and variations are possible in light of the above teachings or may be acquired from practice of the invention. To practice the invention, for example, the top and bottom decks of the apparatus described herein may be implemented using standard size and long-board skateboards, respectively. The top and bottom decks, however, may be other sizes and/or shapes. In this way, the apparatus described herein may be adapted to allow the rider to experience and adapt her center of gravity for orientation changes that occur during performance of one or more particular tricks carried out using boards of particular sizes and/or shapes.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the terms "any of" followed by a listing of a plurality of items and/or a plurality of categories of items, as used herein, are intended to include "any of," "any combination of," "any multiple of," and/or "any combination of multiples of" the items and/or the categories of items, individually or in conjunction with other items and/or other categories of items.

Exemplary embodiments have been illustrated and described. Further, the claims should not be read as limited to the described order or elements unless stated to that effect. In addition, use of the term "means" in any claim is intended to invoke 35 U.S.C. §112, ¶ 6 and any claim without the word "means" is not so intended.

I claim:

1. An apparatus for practicing balance required for a trick of a sporting-board traveling over a given terrain, the apparatus comprising:

a first deck comprising first and second side edges, first and second ends, first and second surfaces and at least one first aperture, wherein the first surface is adapted for a rider;

a second deck having first and second side edges, first and second ends, a centerline defined between the first and second ends, first and second surfaces, and at least one second aperture, wherein the first surface of the second deck is adapted to be in communication with at least a portion of the second surface of the first deck, and wherein the second surface of the second deck is adapted to be positioned over a surface of the ground;

at least one pivot element disposed at least in part in the at least one first and at least one second apertures, wherein the at least one pivot element is adapted to allow the first deck to rotate horizontally about an axis perpendicular to the second deck when the apparatus is in motion, wherein when the first deck is positioned at an angle to the centerline causing the first deck to overhang at least a portion of the first side edge of the second deck, the second surface of the first deck is in communication with the first surface of the second deck above an intersection of the first side edge of the second deck and the first surface of the second deck, thereby permitting the rider to practice maintaining balance with the first deck so positioned and with the apparatus in motion.

2. The apparatus of claim 1, wherein the centerline of the second deck is a first centerline, wherein the first centerline is further defined between the first and second side edges of the second deck, wherein the first deck comprises a second centerline defined between the first and second side ends of the first deck, wherein the at least one second aperture comprises a third centerline, wherein the at least one second aperture is positioned in the second deck so that the first and third centerlines are aligned, wherein the at least one first aperture comprises a fourth centerline, and wherein the at least one first aperture is positioned in the first deck so that the fourth centerline aligns with a given point on the second centerline.

3. The apparatus of claim 2, wherein the second centerline is further defined between the first and second side edges of the first deck, and wherein the given point is at the second centerline.

4. The apparatus of claim 2, wherein the second centerline is further defined between the first and second side edges of the first deck, and wherein the given point is at a given distance from the second centerline toward the first end of the first deck.

5. The apparatus of claim 2, wherein the second centerline is further defined between the first and second side edges of the first deck, and wherein the given point is at a given distance from the second centerline toward the second end of the first deck.

6. The apparatus of claim 2, wherein the second centerline is further defined between the first and second side edges of the first deck, wherein the at least one first aperture comprises third, fourth and fifth apertures, wherein the third aperture is disposed at the second centerline, wherein the fourth aperture is disposed at a given distance from the second centerline toward the first end of the first deck, and wherein the fifth aperture is disposed at a given distance from the second centerline toward the second end of the first deck.

7. The apparatus of claim 6, wherein the at least one second aperture comprises sixth, seventh and eighth apertures, wherein the sixth aperture is disposed at the first centerline, wherein the seventh aperture is disposed at a given distance from the first centerline toward the first end of the second deck, and wherein the eighth aperture is disposed at a given distance from the first centerline toward the second end of the second deck.

8. The apparatus of claim 2, wherein the at least one second aperture comprises sixth, seventh and eighth apertures, wherein the sixth aperture is disposed at the first centerline, wherein the seventh aperture is disposed at a given distance from the first centerline toward the first end of the second deck, and wherein the eighth aperture is disposed at a given distance from the first centerline toward the second end of the second deck.

9. The apparatus of claim 1, wherein the centerline of the second deck is a first centerline, wherein the first deck comprises a second centerline defined between the first and second side ends of the first deck, wherein the at least one pivot element is further adapted to allow the first deck to rotate horizontally about an axis perpendicular to the second deck when the apparatus is in motion so as to allow alignment of the first and second centerlines while the apparatus is in motion.

10. The apparatus of claim 1, wherein the second deck is a long-board skateboard.

11. The apparatus of claim 1, wherein the second deck is a snowboard.

12. The apparatus of claim 1, wherein the centerline is offset towards any of the first and second side edges of the second deck.

13. The apparatus of claim 1, further including a plurality of ground engaging wheels being disposed below the second surface of the second deck to allow the apparatus to roll about on the ground.

14. The apparatus of claim 1, wherein the at least one pivot element comprises an outer surface, and wherein at least a portion of the outer surface is affixed to the second deck.

15. The apparatus of claim 14, wherein the at least one pivot element comprises a bearing, and wherein the bearing is disposed in the at least one second aperture.

16. An apparatus for practicing balance required for a trick of a sporting-board traveling over a given terrain, the apparatus comprising:

a first deck comprising first and second side edges, first and second ends, a first centerline defined between the first and second ends and the first and second side edges, first and second surfaces and first, second and third apertures, wherein the first aperture defining a second centerline, the second aperture defining a third centerline and the third aperture defining a fourth centerline;

a second deck having first and second side edges, first and second ends, a fifth centerline defined between the first and second ends and the first and second side edges, first and second surfaces, and third, fourth and fifth apertures, wherein the fourth aperture defining a fifth centerline, the fifth aperture defining a sixth centerline and the sixth aperture defining a seventh centerline, wherein when the first and fifth centerlines are aligned, the (i) first and fifth centerlines are aligned, (ii) the second and sixth centerlines are aligned, and (iii) the fourth and seventh centerlines are aligned, wherein the first surface of the second deck is adapted to be in communication with at least a portion of the second surface of the first deck, and wherein the second surface of the second deck is adapted to be positioned over a surface of the ground;

at least one pivot element disposed at least in part in one of the (i) first and fourth apertures (ii) second and fifth, and (iii) third and sixth apertures, wherein the at least one pivot element is adapted to allow the first deck to rotate horizontally about an axis perpendicular to the second deck when the apparatus is in motion, wherein when the first deck is positioned at an angle to the second centerline causing the first deck to overhang at least a portion of the first side edge of the second deck, the second surface of the first deck is in communication with the first surface of the second deck above an intersection of the first side edge of the second deck and the first surface of the second deck, thereby permitting the rider to practice maintaining balance with the first deck so positioned and with the apparatus in motion.

* * * * *